US008177483B2

(12) United States Patent
McCallum

(10) Patent No.: US 8,177,483 B2
(45) Date of Patent: May 15, 2012

(54) ACTIVE CASING ALIGNMENT CONTROL SYSTEM AND METHOD

(75) Inventor: Martel Alexander McCallum, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 487 days.

(21) Appl. No.: 12/470,929

(22) Filed: May 22, 2009

(65) Prior Publication Data

US 2010/0296911 A1 Nov. 25, 2010

(51) Int. Cl.
*F01D 21/04* (2006.01)

(52) U.S. Cl. ..... 415/14; 415/127

(58) Field of Classification Search ..... 415/14, 415/126–129, 133, 173.2, 174.1
See application file for complete search history.

(56) References Cited

U.S. PATENT DOCUMENTS

| | | | | |
|---|---|---|---|---|
| 4,063,167 | A | 12/1977 | Duly | |
| 4,330,234 | A * | 5/1982 | Colley | 415/173.2 |
| 4,343,592 | A * | 8/1982 | May | 415/173.2 |
| 4,958,992 | A | 9/1990 | Winiger | |
| 5,263,816 | A | 11/1993 | Weimer et al. | |
| 5,658,125 | A * | 8/1997 | Burns et al. | 415/1 |
| 6,126,390 | A | 10/2000 | Böck | |
| 7,079,957 | B2 * | 7/2006 | Finnigan et al. | 702/33 |
| 7,317,669 | B2 | 1/2008 | Lee | |
| 7,341,426 | B2 | 3/2008 | Schwarz et al. | |
| 2007/0003411 | A1 * | 1/2007 | Manzoori | 415/173.2 |
| 2007/0069598 | A1 | 3/2007 | Kozaki | |
| 2009/0031802 | A1 | 2/2009 | Black et al. | |
| 2009/0053042 | A1 | 2/2009 | Wilson et al. | |

* cited by examiner

*Primary Examiner* — Edward Look
*Assistant Examiner* — Andrew C Knopp
(74) *Attorney, Agent, or Firm* — Dority & Manning, P.A.

(57) ABSTRACT

A gas turbine with an active clearance control system includes a plurality of actuators circumferentially spaced between an inner shroud and an outer casing. The actuators are configured to eccentrically displace the shroud relative to the outer casing. A plurality of sensors circumferentially spaced around the shroud detect a parameter that is indicative of an eccentricity between the rotor and shroud as the rotor rotates within the shroud. A control system in communication with the sensors and actuators is configured to control the actuators to eccentrically displace the shroud to compensate for eccentricities detected between the rotor and shroud.

18 Claims, 3 Drawing Sheets

ACTIVE CASING ALIGNMENT CONTROL SYSTEM AND METHOD

FIELD OF THE INVENTION

The present invention relates generally to rotating machines, such as gas turbines, and more particularly to a system and method for measuring and controlling clearance between the rotor and a surrounding casing structure.

BACKGROUND OF THE INVENTION

Rotating machines such as gas turbines have portions commonly referred to as rotors that rotate within stationary casing components, such as a shroud. Clearance dimensions must be maintained between the rotor and the shroud to prevent impacts between the components. This is a particular concern in gas turbines.

A gas turbine uses hot gases emitted from a combustion chamber to rotate a rotor, which typically includes a plurality of rotor blades circumferentially spaced around a shaft. The rotor shaft is coupled to a compressor for supplying compressed air to the combustion chamber and, in some embodiments, to an electric generator for converting the mechanical energy of the rotor to electrical energy. The rotor blades (sometimes referred to as "buckets") are usually provided in stages along the shaft and rotate within a casing configuration, which may include an outer casing and an inner casing or shroud ring for each respective stage. As the hot gases impinge on the blades, the shaft is turned.

The distance between the tips of the blades and the shroud ring is referred to as "clearance." As the clearance increases, efficiency of the turbine decreases as hot gases escape through the clearance. Therefore, clearance between the blade tips and the shroud should be minimized in order to maximize efficiency of the turbine. On the other hand, if the amount of clearance is too small, then thermal expansion and contraction of the blades, the shroud, and other components may cause the blades to rub the shroud, which can result in damage to the blades, the shroud ring, and the turbine in general. It is important, therefore, to maintain a minimal clearance during a variety of operational conditions.

Methods and systems are known that attempt to maintain an accurate clearance by directing bypass air from the compressor around the casing to reduce thermal expansion of the casing during operation of the turbine. For example, U.S. Pat. No. 6,126,390 describes a passive heating-cooling system wherein the airflow to the turbine casing from the compressor or combustion chamber is metered depending on the temperature of the incoming air so as to control the rate of cooling of the turbine casing, or even to heat the casing.

The conventional passive air-cooling systems, however, assume a uniform circumferential expansion of the rotor and/or shroud and cannot account for eccentricities that either develop or are inherent between the rotor and shroud. Eccentricities can develop as a result of manufacturing or assembly tolerances, or during operation of the turbine as a result of bearing oil lift, thermal growth of the bearing structures, vibrations, uneven thermal expansion of the turbine components, casing slippage, gravity sag, and so forth. Anticipated eccentricities must be accounted for in design and, thus, these eccentricities limit the amount of minimum designed clearance that can be achieved without rubbing between the blades and shrouds. The conventional approach to this problem has been to make static adjustments in relative position of the components during cold assembly to compensate for hot running eccentricity conditions. This method, however, cannot accurately account for the variations in eccentricities that develop during the operational life of the turbine.

Thus, an active alignment control system and method are needed to accurately detect and account for eccentricities that develop between turbine components over a wide range of operating conditions.

BRIEF DESCRIPTION OF THE INVENTION

The present invention provides an active alignment control system and methodology that address certain of the shortcomings of prior control systems. Additional aspects and advantages of the invention will be set forth in part in the following description, or may be obvious from the description, or may be learned through practice of the invention.

In a particular embodiment of a gas turbine with an alignment control system, a rotor is included with at least one stage of rotor blades. The rotor is housed within a casing structure, which may include an outer casing and an inner casing or shroud associated with each stage of rotor blades. A plurality of actuators are circumferentially spaced around the shroud and connect the shroud to the outer casing. For example, four actuators may be circumferentially spaced ninety degrees apart around the shroud. The actuators are configured to eccentrically displace the shroud relative to the outer casing (and thus relative to the rotor). A plurality of sensors are circumferentially spaced around the shroud and are configured to detect or measure a parameter that is indicative of an eccentricity between the rotor and shroud, such as blade tip clearance between the rotor blades and the shroud, as the rotor rotates within the shroud. A control system is configured in communication with the sensors and actuators and controls the actuators to eccentrically displace the shroud to compensate for eccentricities detected in the rotor by the sensors. In a particular embodiment, the control system may be a closed-loop feedback control system.

The present invention also encompasses a method for clearance control in a gas turbine wherein a rotor having at least one stage of circumferentially spaced rotor blades rotates within a casing structure having an outer casing and an inner shroud. In operation of the gas turbine, a parameter indicative of an eccentricity, such as blade tip clearance between the rotor blades and shroud, is sensed by active or passive means at a plurality of locations around the shroud to detect any eccentricities between the rotor and shroud. In response to any detected eccentricities, the method includes eccentrically displacing the shroud relative to the outer casing (and thus relative to the rotor) to compensate for the detected eccentricity as the rotor rotates within the shroud.

The invention also encompasses a rotor to casing alignment system that is relevant to rotating machines in general. This system includes a rotor that rotates within a casing structure, which includes an outer casing and an inner casing. A plurality of actuators are circumferentially spaced around the inner casing and connect the inner casing to the outer casing. The actuators are configured to eccentrically displace the inner casing relative to the outer casing (and thus relative to the rotor). A plurality of sensors are circumferentially spaced around the inner casing and are configured to detect a parameter that is indicative of an eccentricity, such as clearance between the rotor and the inner casing, as the rotor rotates within the inner casing. A control system is in communication with the plurality of sensors and the plurality of actuators and is configured to control the plurality of actuators to eccentrically displace the inner casing to compensate for eccentricities detected between the rotor and the inner casing by the plurality of sensors.

DETAILED DESCRIPTION

Figure 1:
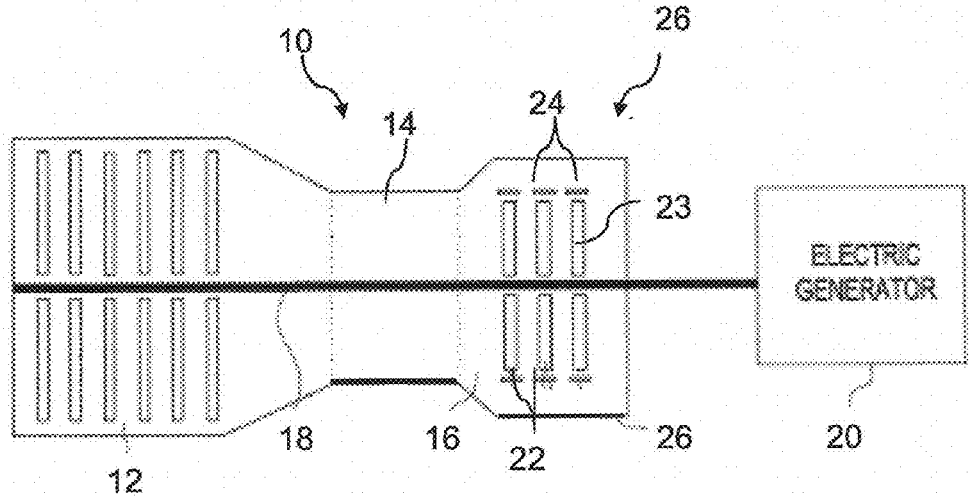
Prior Art Fig. 1
FIG. 1 is a schematic illustration of an exemplary rotating machine, particularly a gas turbine.

Reference is now made to particular embodiments of the invention, one or more examples of which are illustrated in the drawings. Each embodiment is presented by way of explanation of aspects of the invention, and should not be taken as a limitation of the invention. For example, features illustrated or described with respect to one embodiment may be used with another embodiment to yield still further embodiment. It is intended that the present invention include these and other modifications or variations made to the embodiments described herein.

FIG. 1 illustrates an exemplary embodiment of a conventional rotating machine, such as a gas turbine 10. The gas turbine 10 includes a compressor 12, a combustion chamber 14, and a turbine 16. The compressor 12 is coupled to the turbine 16 by a turbine shaft 18, which may in turn be coupled to an electric generator 20. The turbine 16 includes turbine stages 22, a respective inner casing or shroud 24 (which may be a common single casing structure or individual rings), and an outer casing structure 26. Each turbine stage 22 includes a plurality of turbine blades 23.

Aspects of the present invention will be described herein with respect to a gas turbine configuration. However, it should be appreciated that the present invention is not limited to gas turbines, and is applicable to rotating machines in general wherein it is desired to detect and compensate for eccentricities between a rotor and a surrounding casing structure.

Construction and operation of conventional gas turbine configurations is well known by those skilled in the art, and a detailed explanation thereof is not necessary for an understanding of the present invention. Also, the simplified turbine 10 in FIG. 1 is merely representative of any type of suitable turbine or other rotating machine configuration, and it should be appreciated that the present system and methodology have usefulness with various turbine configurations and are not limited to any particularly type of gas turbine or other rotating machine.

Figure 2A:
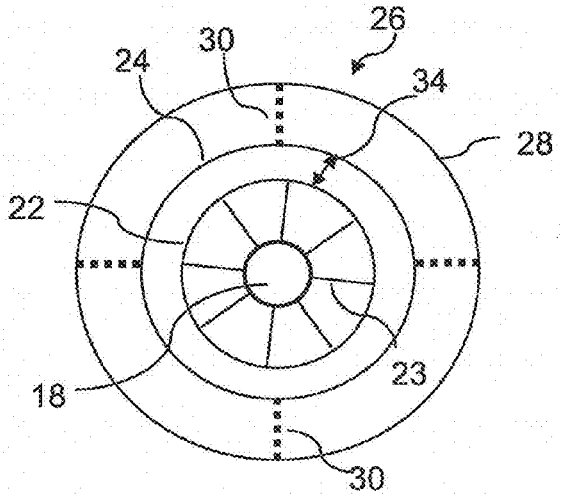
FIG. 2A is a diagrammatic cross-sectional view illustrating a generally uniform concentric relationship between a rotor and a shroud of a rotating machine, such as a gas turbine.

FIG. 2A is a diagrammatic view that illustrates a turbine stage 22 having individual blades or buckets 23 mounted on a rotor shaft 18. The turbine stage 22 rotates within an inner shroud 24 (a single inner casing structure common to all of the turbine stages or individual shroud rings), which is concentric within an outer casing 28 of the casing structure 26. An ideal blade tip clearance 34 is desired between the tips of the rotating blades 23 and the inner shroud 24. This clearance 34 is grossly exaggerated in FIG. 2A for illustrative purposes.

Figure 2B:
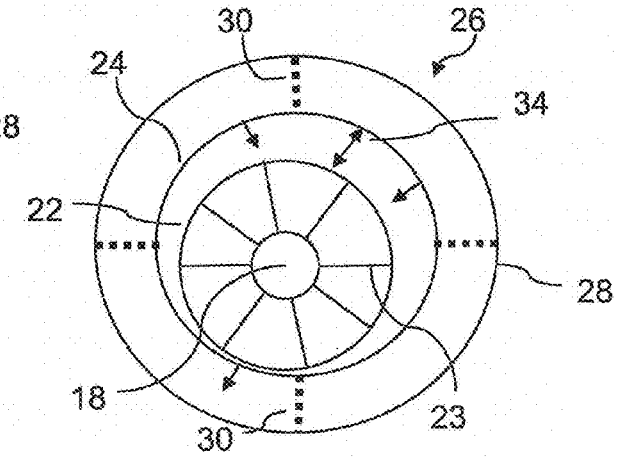
FIG. 2B is a diagrammatic cross-sectional view illustrating an eccentric relationship between a rotor and a shroud of a rotating machine, such as a gas turbine.

As illustrated in FIG. 2B, eccentricities can develop between the turbine stage 22 and the inner shroud 24. These eccentricities may be the result of any combination of factors, such as manufacturing or assembly tolerances, bearing alignment, bearing oil lift, thermal growth of bearing structures, vibrations, uneven thermal expansion of the turbine components, casing slippage, gravity sag, and so forth. The eccentric relationship may result in a turbine blade clearance 34 that is itself eccentric in nature, as illustrated in FIG. 2B. The eccentricity may result in a turbine blade clearance that is below a minimum acceptable specification, and which can result in rubbing between the tips of the blades 23 and the inner shroud 24. In addition, the eccentricity can result in a blade tip clearance that exceeds a design specification, which can result in significant rotor losses.

FIGS. 2A and 2B illustrate actuators 30 that serve to connect the inner shroud 24 to the outer casing 28 of the casing structure 26. As discussed in greater detail below, these actuators 30 also provide a means for actively compensating for essentially instantaneously detected eccentricities between the turbine stage 22 and shroud 24.

Figure 3:
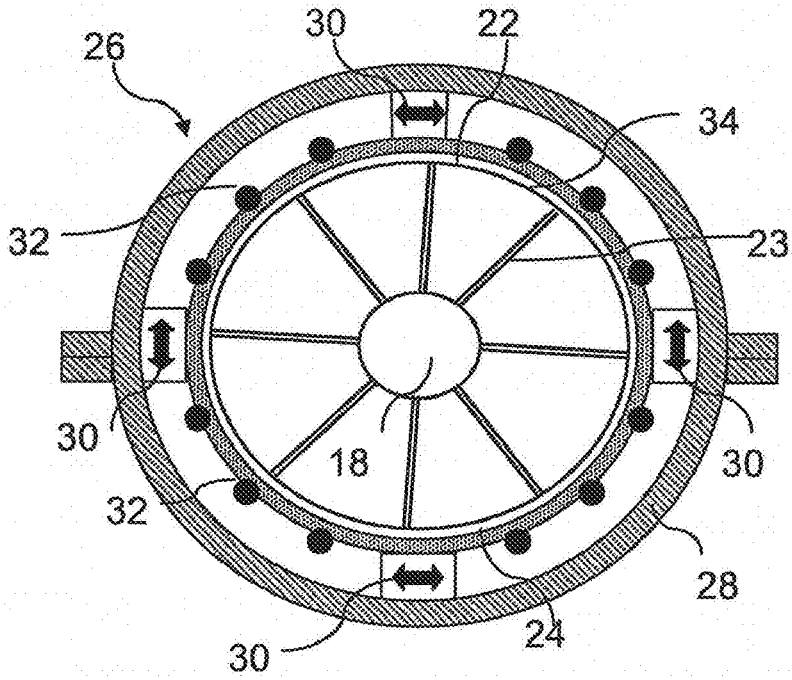
FIG. 3 is a diagrammatic cross-sectional view of a gas turbine incorporating sensors and actuators to compensate for eccentricities between the rotor and shroud.
Figure 4:
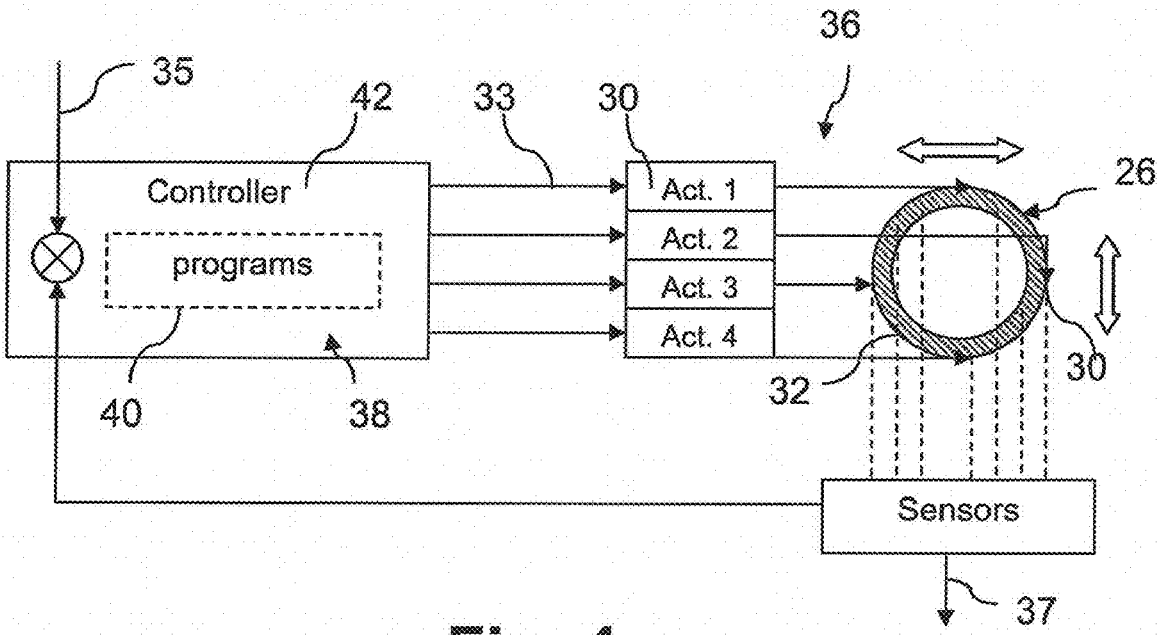
FIG. 4 is an exemplary view of a control system.

Referring more particularly to FIGS. 3 and 4, a plurality of actuators 30 are circumferentially spaced around the inner shroud 24. The number and position of actuators 30 may vary, but desirably the actuators 30 allow for complete circumferential compensation of any detected eccentricity between the turbine stage 22 and inner shroud 24. The actuators 30 are configured to eccentrically displace the shroud 24 relative to the outer casing 28. The actuators 30 are not limited in their design or construction, and may include any manner of pneumatic, hydraulic, electric, thermal, or mechanical actuating mechanism. For example, the actuators 30 may be configured as individually controlled electric motors, pneumatic or hydraulic pistons, servos, threaded or geared arrangements, and the like. In the illustrated embodiment, four actuators 30 are equally spaced ninety degrees apart around the circumference of the shroud 24. The top and bottom actuators 30 provide vertical adjustment, and the left and right actuators 30 provide horizontal adjustment. The combination of actuators 30 provide any desired degrees of horizontal and vertical adjustment around the complete circumference of the inner shroud 24.

A plurality of clearance sensors 32 are circumferentially spaced around the inner shroud 24 of the turbine section and are configured to measure blade tip clearance 34 between the tips of the rotor blades 23 and the inner shroud 24 as the rotors stage 22 rotates within the shroud 24. The number and location of these sensors 32 may vary, but desirably are sufficient to detect any manner of eccentricity around the circumference of the inner shroud 24. Various types of blade tip sensors are known and used in the art, and any one or combination of such sensors may be used within the scope and spirit of the present invention. For example, the sensors 32 may be passive devices, such as capacitive or inductance sensors that react to a change in measured capacitance or inductance generated by passage of the metal blade tips under the sensor, with the magnitude of change reflecting a relative degree of blade tip clearance. Typically, these types of capacitive sensors are mounted in recesses within the shroud 24 so as to be flush with an inner circumferential surface of the shroud 24. In alternative embodiments, the sensors 32 may be any manner or configuration of active sensing devices, such as a microwave transmitter/receiver sensor, laser transmitter/receiver sensor, and the like. In still an alternative embodiment, the active sensors 32 may comprise an optical configuration wherein light is transmitted to and reflected from the turbine blades.

It should be readily appreciated that the present invention is not limited by the type or configuration of sensors, and that any manner or configuration of known or developed sensors, or other devices, may be utilized to detect an eccentricity by measuring or detecting a parameter that is indicative of an eccentricity between the rotor and surrounding structure. This parameter may be, for example, blade tip clearance, as discussed herein.

Referring to FIG. 4, an exemplary control system 36 is configured in communication with the sensors 32 and actuators 30. The control system may comprise software implemented programs that calculate a magnitude and circumferential position of a rotor eccentricity from signals received from the sensors, and that control the actuators to compensate for the calculated rotor eccentricity as the rotor rotates within the shroud.

The control system 36 includes a controller 42 configured with any manner of hardware or software programs 40 to calculate an eccentricity from the blade tip clearance measurements of the various respective sensors 32. The control system 36, in one particular embodiment, is configured as a closed-loop feedback system 38 wherein an eccentricity is essentially instantaneously calculated from signals generated by sensors 32. The control system 36 then generates a control signal 33 to each of the respective actuators 30. The actuators 30, in response to the control signals 33, shift the inner shroud 24 relative to the outer casing 28 (and thus relative to the rotor) to minimize the eccentricity to within acceptable limits. As the inner shroud 24 is repositioned, the sensors 32 continuously sense blade tip clearance 34 and the calculated eccentricity is continuously monitored. It should be readily appreciated that the control system 36 may include any number of control features, such as a dampening or time delay circuit, or any other type of known closed-loop feedback control system function to ensure that the system makes the minimum number of required adjustments to maintain eccentricity within acceptable limits. For example, the control system 36 may be configured so as to make incremental adjustments to the position of the shroud 24, and to have a predefined wait period between each adjustment in order to allow any change in a detected eccentricity to steady out prior to making subsequent adjustments.

The control system 36 may receive inputs 35 related to its function, for example eccentricity set points, adjustment controls, and the like, or from any other related control system. In addition, an output 37 from the sensors may be used by any other related control system or equipment for any reason, such as diagnostics, maintenance, and the like.

Figure 5:
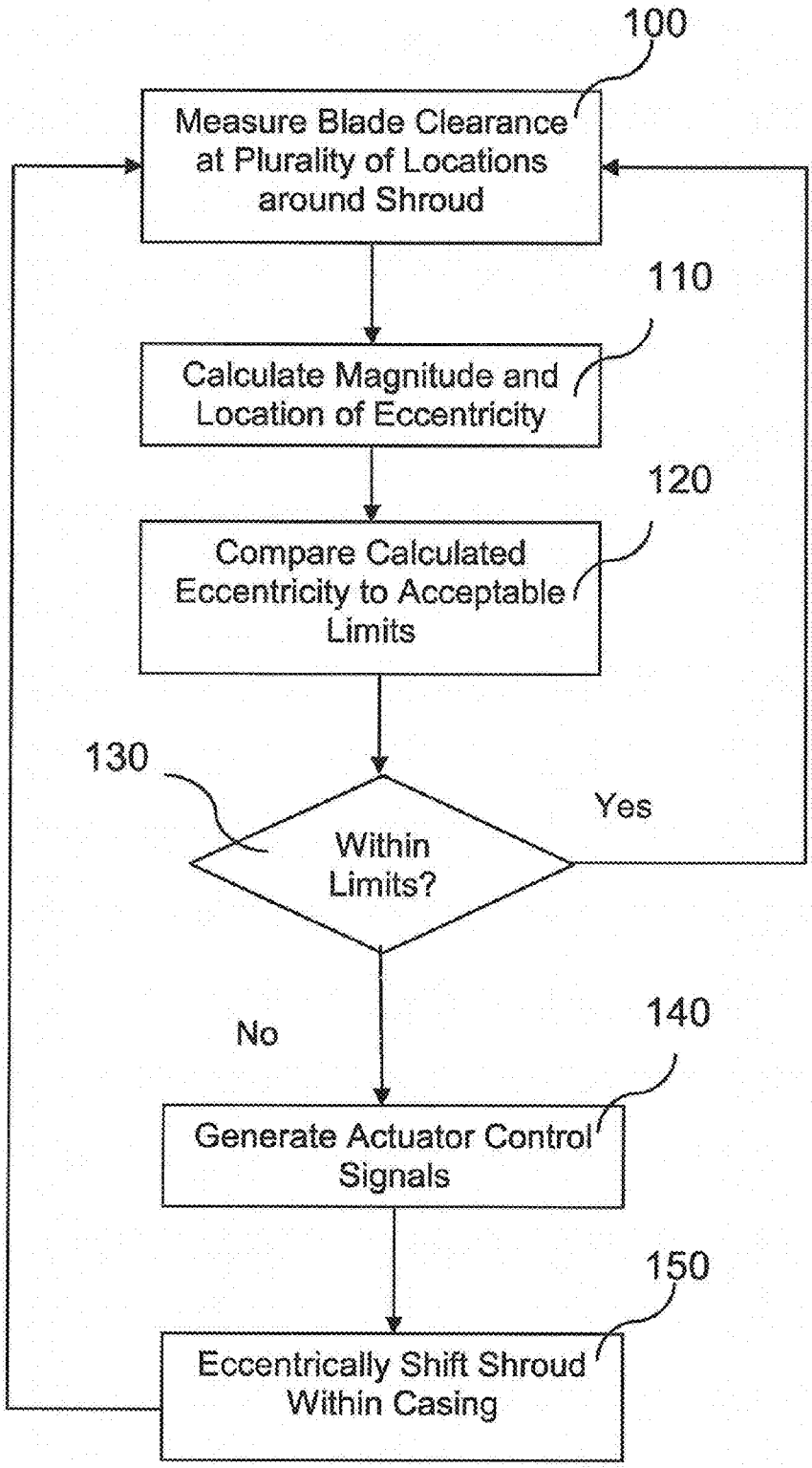
FIG. 5 is a flow chart of a method embodiment of the invention.

FIG. 5 depicts a flow chart that is exemplary of an embodiment of the present control methodology. At step 100, blade tip clearance is measured at a plurality of locations around the shroud as the turbine rotates within the shroud. As discussed above, the blade tip clearance may be sensed by any manner of sensors disposed circumferentially around the shroud.

At step 110, the measured blade tip clearances are used to calculate the magnitude and relative circumferential location of any eccentricity between the shroud and rotor.

At step 120, the calculated eccentricity is compared to a predefined acceptable limit.

At step 130, if the calculated eccentricity is within limits, then the monitoring process continues at step 100.

At step 130, if the calculated eccentricity exceeds an acceptable set point, then the control system generates actuator control signals at step 140, which are applied to the various actuators disposed around the shroud to eccentrically shift the shroud within the casing at step 150 to compensate for the eccentricity. As discussed above, the adjustments made by the actuators may be in incremental steps, or may be in a single step calculated to compensate for the entire eccentricity. After each adjustment to the shroud, monitoring continues at step 100.

It should be readily appreciated that the closed-loop type of feedback system illustrated in the system of FIG. 4 and the methodology of FIG. 5 is not a limitation of the invention. Various types of control systems may be readily devised by those skilled in the art to achieve the purposes of eccentrically shifting the inner shroud within the outer casing in order to compensate for eccentricities between the rotor and shroud.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A gas turbine with a clearance control system, comprising:

a rotor with at least one stage of rotor blades;

a casing structure, said rotor housed within said casing structure, said casing structure including a stationary outer casing and an inner shroud associated with each said stage of rotor blades, said inner shroud displaceable relative to said outer casing;

a plurality of actuators contained within said outer casing and circumferentially spaced around said shroud and radially connecting said shroud to said outer casing, said plurality of actuators configured to eccentrically displace said shroud relative to said outer casing;

a plurality of sensors circumferentially spaced around said shroud and configured to measure a parameter indicative of an eccentricity between said rotor and said shroud as said rotor rotates within said shroud; and a control system in communication with said plurality of sensors and said plurality of actuators and configured to control said plurality of actuators to eccentrically displace said shroud to compensate for eccentricities detected between said rotor and said shroud by said plurality of sensors.

2. The gas turbine as in claim 1, comprising at least four said actuators spaced 90 degrees apart around said shroud.

3. The gas turbine as in claim 1, wherein said plurality of actuators are any one of a pneumatic, mechanical, or hydraulic mechanism.

4. The gas turbine as in claim 1, wherein said control system comprises a closed-loop feedback system.

5. The gas turbine as in claim 4, wherein said control system comprises software implemented programs that calculate a magnitude and rotational position of a rotor eccentricity from signals received from said plurality of sensors, and control said plurality of actuators to compensate for the calculated rotor eccentricity as the rotor rotates within said shroud.

6. The gas turbine as in claim 1, wherein said plurality of sensors are active clearance sensors circumferentially spaced around said shroud to measure blade tip clearance between said rotor blades and said shroud by transmitting and receiving a signal reflected from said rotor blades.

7. The gas turbine as in claim 1, wherein said plurality of sensors are passive clearance sensors circumferentially spaced around said shroud to measure blade tip clearance between said rotor blades and said shroud.

8. A method for clearance control in a gas turbine wherein a rotor having at least one stage of circumferentially spaced rotor blades rotates within a stationary casing structure having a displaceable inner shroud within the casing structure, said method comprising:

in operation of the gas turbine, detecting eccentricities between the rotor and shroud by sensing a parameter indicative of an eccentricity as the rotor rotates within the shroud; and in response to any detected eccentricities, eccentrically displacing the shroud relative to the casing structure with actuators contained within the casing structure and operably disposed between and connecting the shroud and casing structure to compensate for the detected eccentricity as the rotor rotates within the shroud.

9. The method as in claim 8, comprising sensing blade tip clearance between the rotor blades and shroud at a plurality of locations around the shroud, and calculating a magnitude and relative rotational position of the eccentricity so as to continuously compensate for the eccentricity as the rotor rotates within the shroud.

10. The method as in claim 9, comprising actively sensing blade tip clearance with active sensors circumferentially spaced around the shroud.

11. The method as in claim 9, comprising passively sensing blade tip clearance with passive sensors circumferentially spaced around the shroud.

12. The method as in claim 8, comprising sensing blade tip clearance at a plurality of locations around the shroud, calculating a magnitude and relative rotational position of the eccentricity, and in a closed-loop feed back system continuously controlling the actuators to compensate for the eccentricity as the rotor rotates within the shroud.

13. A rotor to casing alignment system, comprising:

a rotor;

a casing structure, said rotor housed within said casing structure, said casing structure including an outer casing and an inner casing that is displaceable relative to said outer casing;

a plurality of actuators contained within said outer casing and circumferentially spaced around said inner casing and connecting said inner casing to said outer casing, said plurality of actuators configured to eccentrically displace said inner casing relative to said outer casing;

a plurality of sensors circumferentially spaced around said inner casing and configured to detect an eccentricity between said rotor and said inner casing as said rotor rotates within said inner casing; and a control system in communication with said plurality of sensors and said plurality of actuators and configured to control said plurality of actuators to eccentrically displace said inner casing to compensate for eccentricities detected between said rotor and said inner casing by said plurality of sensors.

14. The system as in claim 13, comprising at least four said actuators spaced 90 degrees apart around said inner casing.

15. The system as in claim 13, wherein said control system comprises a closed-loop feedback system.

16. The system as in claim 15, wherein said control system comprises software implemented programs that calculate a magnitude and rotational position of a rotor eccentricity from signals received from said plurality of sensors, and control said plurality of actuators to compensate for the calculated rotor eccentricity as the rotor rotates within said inner casing.

17. The system as in claim 13, wherein said plurality of sensors are active sensors circumferentially spaced around said inner casing that transmit and receive a signal reflected from said rotor.

18. The system as in claim 13, wherein said plurality of sensors are passive sensors circumferentially spaced around said inner casing.

* * * * *